US005362369A

United States Patent [19]

Mayr et al.

[11] Patent Number: 5,362,369

[45] Date of Patent: Nov. 8, 1994

[54] FULLY AUTOMATIC CURRENT CONTROL FOR METAL DEPLETION CELLS

[75] Inventors: Max Mayr, Alzenau; Wolfgang Blatt, Wächtersbach; Harri Heinke, Erlensee, all of Germany

[73] Assignee: Heraeus Elektrochemie GmbH, Hanau, Germany

[21] Appl. No.: 923,941

[22] PCT Filed: Jan. 12, 1991

[86] PCT No.: PCT/EP91/00044

§ 371 Date: Sep. 3, 1992

§ 102(e) Date: Sep. 3, 1992

[87] PCT Pub. No.: WO86/06761

PCT Pub. Date: Nov. 20, 1986

[30] Foreign Application Priority Data

Mar. 3, 1990 [DE] Germany ..... 4006751

[51] Int. Cl.[5] ..... C25C 7/06; C25D 21/12

[52] U.S. Cl. ..... 204/105 R; 204/129; 204/153.1; 204/228; 204/400

[58] Field of Search ..... 204/105 R, 129, 153.1, 204/228, 400

[56] References Cited

U.S. PATENT DOCUMENTS 4,139,431 2/1979 Scheidegger+/Ciba ..... 204/109
4,619,749 10/1986 Nusbaum ..... 204/228
4,666,567 5/1987 Loch ..... 204/228
4,776,931 10/1988 Hardy ..... 204/105 R
4,906,340 3/1990 Brown ..... 204/14.1

FOREIGN PATENT DOCUMENTS 227570 1/1976 France .
2808095 8/1978 Germany .
3922959 12/1989 Germany .
1500748 2/1978 United Kingdom .
1534117 11/1978 United Kingdom .
1498828 7/1989 U.S.S.R. .
1527330 7/1989 U.S.S.R. .

*Primary Examiner*—John Niebling
*Assistant Examiner*—Brendan Mee
*Attorney, Agent, or Firm*—Frishauf, Holtz, Goodman & Woodward

[57] ABSTRACT

An electrolytic cell, for demetallization of a solution containing metal ions, has a hydrogen sensor connected to a control and monitoring unit which controls the intensity of current applied across the cell's electrodes. Whenever the hydrogen concentration above the solution surface in the cell reaches a predetermined undesirably high level, the control unit makes a stepwise reduction in the applied current. This stepwise reduction continues until the ions in the solution are depleted to a predetermined level, at which point the solution is replaced.

10 Claims, 3 Drawing Sheets

FULLY AUTOMATIC CURRENT CONTROL FOR METAL DEPLETION CELLS

FIELD OF THE INVENTION

BACKGROUND

The invention relates to a process for electrolytic demetallization of a solution containing metal ions where an electrical d.c. current is controlled between an anode submerged in the solution and a cathode by means of a programmable control unit in such a way that the current intensity is reduced in steps to an approximately constant value during sequentially timed intervals until the remaining concentration of the metal ions falls below a predetermined value, as well as to an apparatus for current control in an electrolytic metal depletion cell.

A process for electrolytic desilverization of photographic fixing baths is known from DE-OS 28 08 095, and U.S. Pat. No. 4,139,431 in which the solution to be desilvered is circulated in a closed cycle from a reservoir through an electrolysis cell and back again, where the volume of the cell and the circulated amount per unit of time are selected or adjusted in such a way that the dwell time of the electrolyte in the electrolysis cell is at most one minute. The electrode load is reduced in sequentially timed steps; in the course of this, a pH-adjusted redox system is supplied to the solution to be desilvered. In an apparatus for executing the process, a constant current is reduced in steps in sequentially timed intervals until the remaining concentration falls below a predetermined value. In this manner the electrode load can be applied by means of a preprogrammed automatic control with the aid of a programmable control in which all or at least a part of the values to be controlled are automatically controlled in accordance with a preselectable program.

In this connection it has proven to be problematical that this is a mere control apparatus without any comparison measurements between a desired set value and a measured actual value. Optimization of the electrochemical process with maximum energy yield is not possible because of the mechanical control.

An electrode potential control for electrolysis in connection with the retrieval of silver from photographic solutions is furthermore known from DE-OS 39 22 959, Dittrich et al., where an electrode potential of the working cathode affected by the electrolysis current is measured by means of a reference electrode.

This is a continuous potentio-static control, the electrolyte throughput amount of which is comparatively small because of its system-defined limit current; additionally, such a control can only be used in a device of one anode and one cathode each, because the pair of measuring electrodes only provides the values for a single cathode.

It is the object of an invention to provide a process for automatic current control of metal depletion cells while using as high as possible a current density; it is furthermore intended to create an autonomous apparatus with a control unit taking into consideration the progress of the electro-chemical process, which reduces the cell current in steps; in addition it is intended to use the automatic current control also with cells having a plurality of cathodes placed opposite of one or two anodes.

The set value of the current is preferably reduced by an amount which in relation to the preset value lies in the range of between 1:1.5 to 1:7. In this case the solution is supplied to the metal depletion cell in batches.

In a preferred embodiment of the apparatus, the electronic evaluation device has a monostable trigger circuit for the pulse generation; the input of the set value set point adjuster is provided with a pulse counter, where each count of the counter corresponds to a predetermined set value of the current.

The large energy yield and the short metal extraction period prove to be advantageous.

DRAWINGS

The subject of the invention will be explained in detail below by means of FIGS. 1 to 3:

FIG. 1 illustrates the connection between maximally possible current densities and the concentration of the solution in mg/l in connection with copper precipitation, FIG. 2 illustrates the functional progression by means of a control circuit; in FIG. 3 the schematic association of individual components of the apparatus of the invention is illustrated.

DETAILED DESCRIPTION

Figure 1:
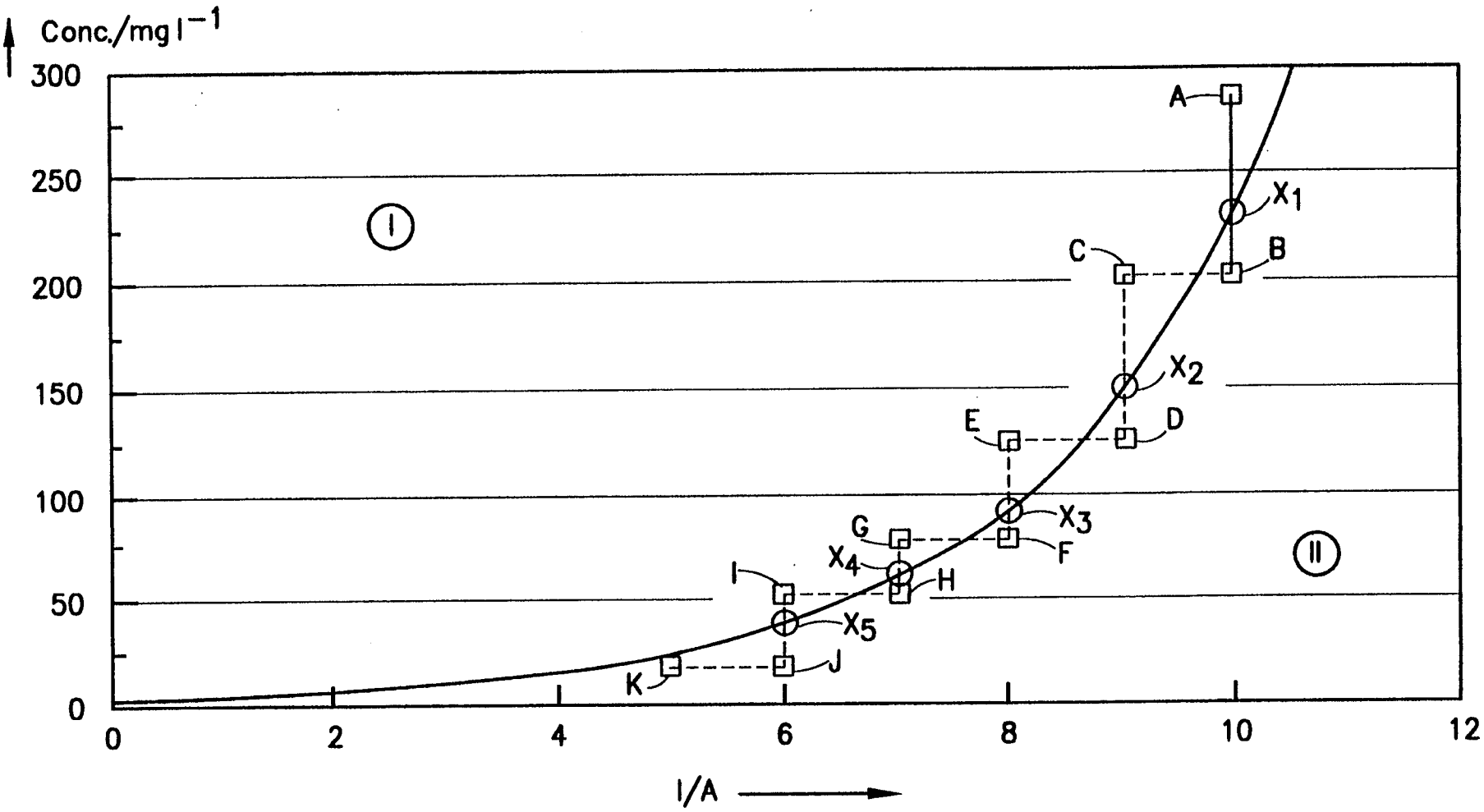

The function illustrated in FIG. 1 divides the diagram into an area I, in which there is no gassing, and an area II, in which the current density at the electrodes of the metal depletion cell is so high in comparison to the contents of the solution, that hydrogen generation takes place.

The electrode plate used as a cathode has an area of 480×690 mm and consists of copper mesh.

In accordance with FIG. 1, depletion takes place in stage 1 with a current intensity of 10 A per cathode. The functional relationship in a solution with a content of 280 mg/l is illustrated by means of the position A in the area I. In stage 1, depletion takes place at a constant current intensity of 10 A until the gassing area II has been reached at point $X_1$ of the characteristic line and hydrogen generation starts. When a predetermined hydrogen amount of 1% at point B has been reached, the content has been reduced to approximately 215 mg/l. After reaching the pre-determined 1% hydrogen content, the current intensity per cathode is lowered to 9 A in stage 2, this switch point being indicated by C. Starting at point C, the content of the solution is demetallized at a constant current until hydrogen generation again starts at point $X_2$ and, subsequent to attaining the pre-determined hydrogen content of 1% at point D, reduction of the current to 8 A again takes place at switch point E in stage 3. Starting with a content of approximately 125 mg/l, the solution is again demetallized at a constant current intensity of 8 A until the characteristic line is breached at point $X_3$ and hydrogen generation starts again. After reaching the pre-determined hydrogen value of 1%, for example, at point F of the diagram, a lower stage is again switched on, resulting in a cathode current intensity of 7 A; this stage 4 starts at point G, where again metal depletion takes place until the characteristic line is passed at point $X_4$, and at point H the cathode current intensity is again reduced by one stage to 6 A per cathode at the switch point I. This cycle is repeated until the depletion has reached a remaining content of approximately 10 mg/l at point K; when point K is reached, a signal is triggered and a batch change of the solution is made.

Figure 2:
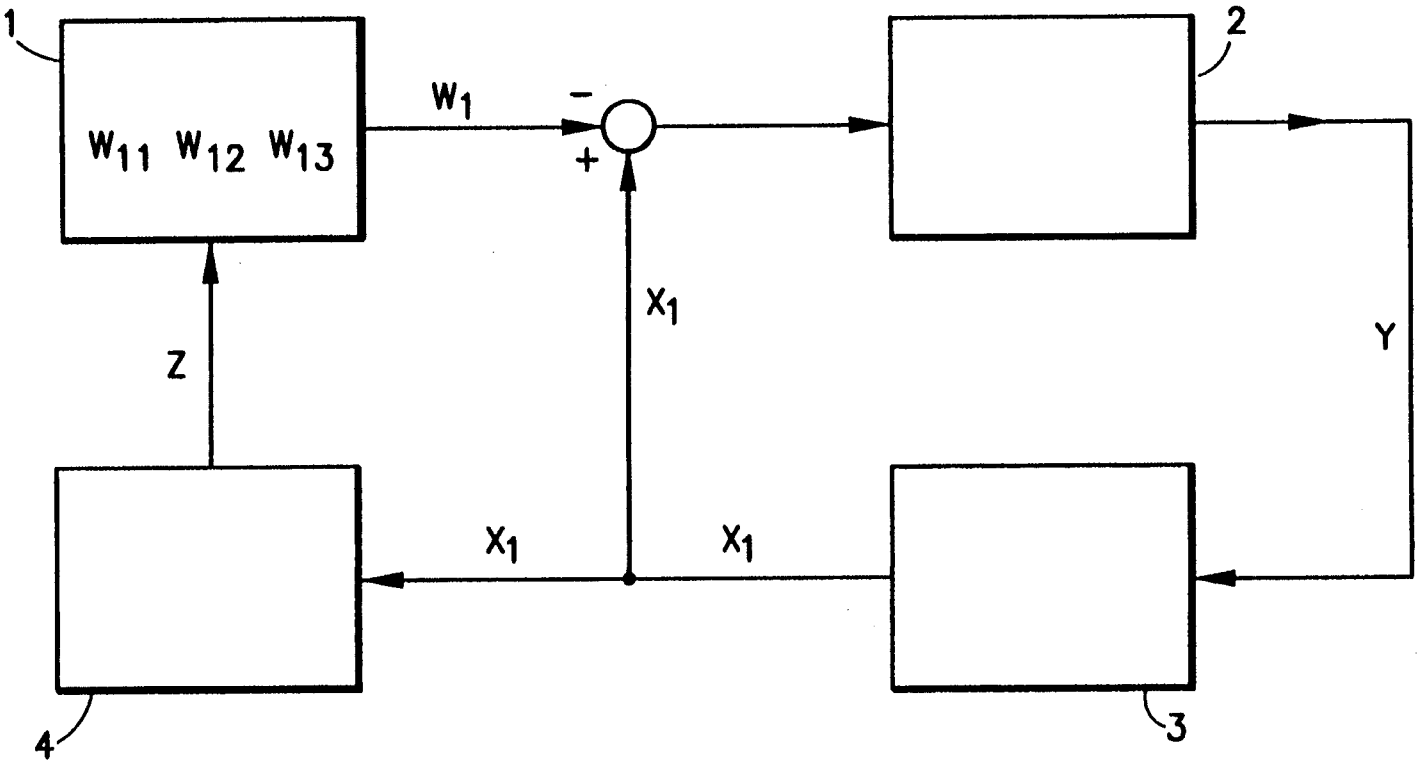

In accordance with the functional progression by means of a control circuit illustrated in FIG. 2, the set values of the current of the individual stages are stored in the set value adjuster 1; the difference between the command variable $W_I$ provided by the set value adjuster and the actual value of the cell current $X_I$ is calculated and supplied to the control unit 2 as control deviation. The control unit 2 generates a set value Y which is supplied to the final control element 3 for controlling the current intensity in the cell. The final control element 3 passes on the control signal in the form of current intensity or signal of the intensity of the cell current $X_I$ to the cell 4, while at the same time the signal $X_I$ is supplied as the actual value to the difference input of the control unit 2.

The functional progression can be described by means of an example, as follows:

At the start, in stage 1 the set value $W_{I1}$ is preset as the command variable of the current intensity in the cell where, for example as a result of a control deviation because of too small an actual value $X_{I1}$, the control unit 2 emits a set value Y until the final control element 3 generates an actual value $X_{I1}$ which corresponds to the command variable $W_{I1}$ and the control deviation thus becomes zero; the controlled current $X_{I1}$ is now supplied to the cell 4 until, because of hydrogen generation, a pulse Z is emitted in the cell, which increments the counter of the set value adjuster 1 from position 1 to position 2 and thus from the set value $W_{I1}$ to the set value $W_{I2}$; the control deviation now appearing at the input of the control unit 2 results in the set value Y acting on the final control element 3, where the final control element is being adjusted until the actual value $X_{I2}$ of the current intensity in the cell corresponds to the new command variable $W_{I2}$ and in this way the control deviation again becomes zero. The current of the stage $X_{I2}$ is then supplied to the cell 4 until hydrogen generation again occurs and a further pulse Z is being forwarded to the counter of the set value adjuster 1 and the latter is put into position 3; simultaneously the set value $W_{I3}$ is supplied as the new command variable to the difference point at the input of the control unit 2 which—as already explained above —now adapts the actual value $X_{I3}$ to this new command variable and maintains it, until the hydrogen generation in the cell 4 again exceeds a preset value and a pulse Z is being forwarded to the set value adjuster 1.

Figure 3:
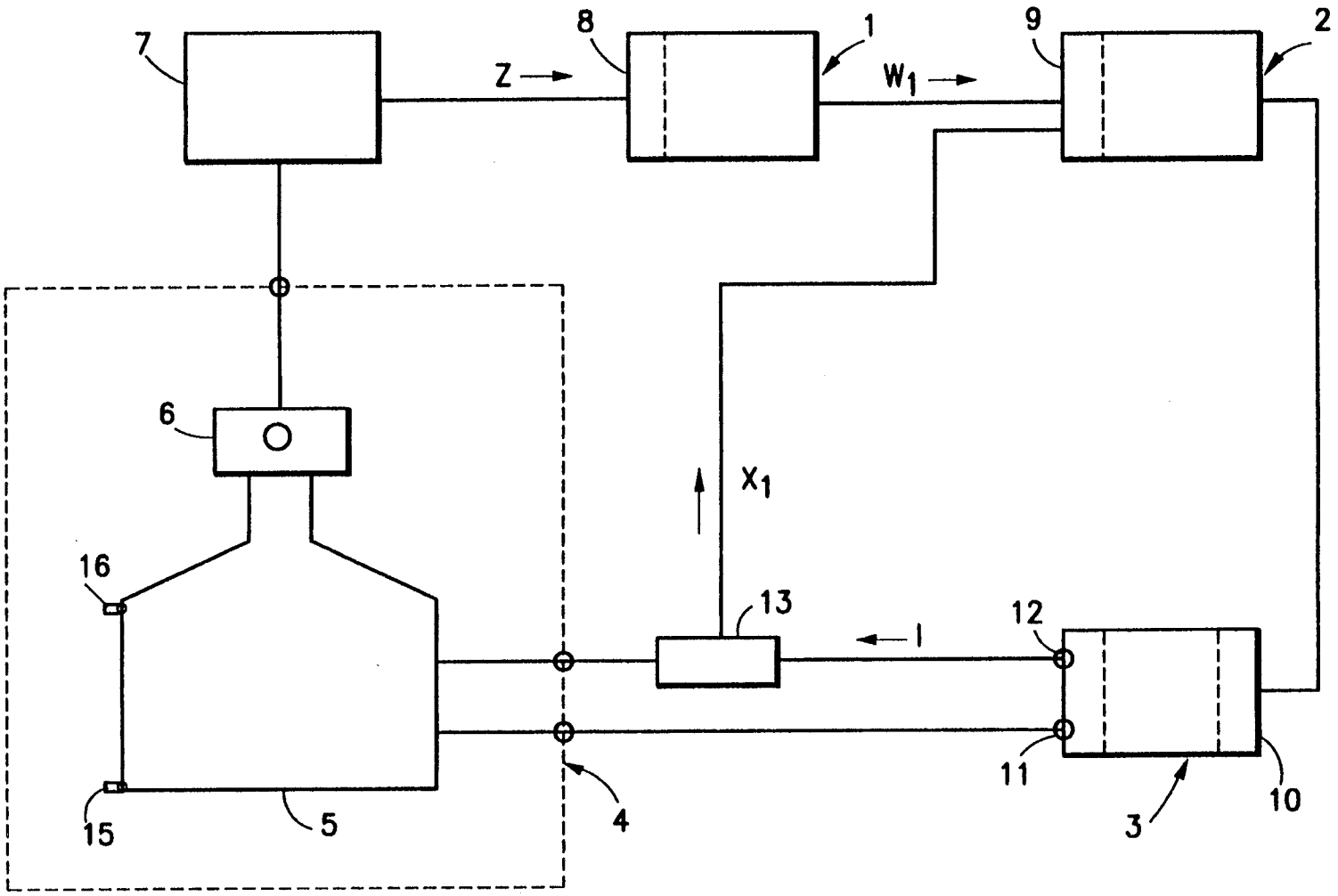

In a block diagram, FIG. 3 schematically shows the apparatus in accordance with the invention; the reference numerals of the functional cycle employed in connection with FIG. 2 are being used here to the extent possible. However, the cell which up to now was shown with the reference numeral 4 has been divided here into the actual electrolysis cell 5 and the sensor head acting as a hydrogen sensor 6, which is connected via an electrical line to the electronic evaluation device 7 which, in turn, is connected with the input of the set value adjuster 1. The set value adjuster 1 has a counter 8 on its input, which counts the pulses Z detected by the electronic evaluation device 7 in the course of each hydrogen gas generation exceeding a predetermined threshold value, and which each time generates a set value $W_I$ for the intensity of the cell current I on the basis of the count of the counter; the number of set values corresponds to the stages of the counter; for example, with eight counting positions, eight set values $W_I$ for the current intensities are stored and are supplied to the difference input 9 of the control unit 2. The output of the control unit 2 supplies its control signal to the input 10 of the final control element 3 used to control the current intensity.

The final control element 3 operates as a voltage-controlled current source and generates, with the aid of the voltage transmitted in the form of the set signal Y, an output current proportional with the voltage, which is supplied to the cell 5. At the shunt 13 the current I emitted via the contacts 11, 12 generates a voltage proportional to the current I which is supplied as the control value $X_I$ for the actual value of the current intensity to the difference input 9 of the control unit 2. As soon as hydrogen generation starts in the cell 5 and exceeds a preset value, the hydrogen sensor 6 emits an electrical signal to the electronic evaluation device 7, which forms a pulse from the signal emitted by the sensor head and passes it on to the input of the counter 8 of the set value adjuster 1. Following stepped reduction of the set value of the current intensity, hydrogen generation continues to occur in the cell—as already explained above—until the predetermined remaining contents have been attained. The shut-off signal required when the remaining contents have been attained is preset by the count of the counter. It is furthermore possible to actuate a valve control with the aid of the shut-off signal, which removes the electrolyte from which the metal has been removed as much as possible by opening the outlet valve 15 and, following closing of the outlet valve 15, returns the count of the counter to 1 and supplies fresh electrolyte to be demetallized to the cell 5 via a float-controlled inlet valve 16.

We claim:

1. In a system for processing of a metal-ion-containing solution, including an electrolytic cell (4) adapted for holding said solution, an anode and a cathode adapted for immersion in said solution, a control unit (2,3) controlling current applied to said anode and said cathode, and a sensor (6) disposed above said solution for measuring concentration of any hydrogen evolved during said processing of said solution, a process for electrolytic demetallization of said solution, comprising the steps of applying an electrical d.c. current between said anode and said cathode;

feeding measurements of said hydrogen concentration above said solution from said sensor (6) to said control unit (2,3); and making a stepwise reduction, whenever said hydrogen concentration exceeds a respective predetermined percental value, in intensity of said current applied between said anode and said cathode, incrementing (Z) a stored value in a counter (8) each time such a stepwise current reduction is made, and ceasing application of current when a predetermined counter value, indicative of a predetermined remaining concentration of the metal ions, is reached.

2. A process in accordance with claim 1, further comprising the steps of feeding a measurement output signal of the hydrogen sensor (6) to a set value adjuster (1);

feeding a set value signal generated by the set value adjuster (1) as a command variable to an input of said control unit (2,3);

comparing, in said control unit (2,3), said command variable with an actual value of said current intensity; and adjusting the actual value of the current intensity by means of a control signal, until the difference between the actual value and the command variable is zero.

3. A process in accordance with claim 1,
further comprising the steps of
temporarily ceasing application of said current after the remaining concentration of the metal ions falls below said predetermined value,
directing, into said cell, solution containing additional metal ions, and
resuming said application of said current to said cell (4).

4. A process in accordance with claim 2,
further comprising the steps of
temporarily ceasing application of said current after the remaining concentration of the metal ions falls below said predetermined value,
directing, into said cell, solution containing additional metal ions, and
resuming said application of said current to said cell (4).

5. A process for electrolytic demetallization according to claim 1, wherein
said predetermined percental value is one percent hydrogen.

6. A process for electrolytic demetallization according to claim 1, wherein
said predetermined counter value is eight.

7. An apparatus for control of current in an electrolytic demetallizing cell adapted to be filled with an aqueous solution containing metal ions,
comprising
a programmable control unit (2) with a final control element (3) connected downstream thereof as a control device for controlling the intensity of current applied between an anode and a cathode of said cell,
at least one hydrogen sensor (6), located in said cell above a top surface of said solution, and generating an output signal;
an electronic evaluation device (7) receiving said output signal of said hydrogen sensor (6) and acting as a threshold value switch; and
a set value adjuster (1) for the current intensity, having a control input connected to an output of said electronic evaluation device (7) and an output which is connected to an input of the control unit (2).

8. An apparatus in accordance with claim 7,
wherein
the electronic evaluation device (7) has a monostable trigger circuit for pulse generation.

9. An apparatus in accordance with claim 7,
wherein the input of the set value adjuster (1) has a pulse counter (8), and wherein each respective count value of the counter corresponds to a respective predetermined set value of the current.

10. An apparatus in accordance with claim 8,
wherein the input of the set value adjuster (1) has a pulse counter (8), and wherein each respective count value of the counter corresponds to a respective predetermined set value of the current.

* * * * *